US007063131B2

(12) United States Patent
Northrop

(10) Patent No.: US 7,063,131 B2
(45) Date of Patent: Jun. 20, 2006

(54) PERFORATED FIN HEAT EXCHANGERS AND CATALYTIC SUPPORT

(75) Inventor: William F. Northrop, Somerville, MA (US)

(73) Assignee: Nuvera Fuel Cells, Inc., Cambridge, MA (US)

( * ) Notice: Subject to any disclaimer, the term of this patent is extended or adjusted under 35 U.S.C. 154(b) by 117 days.

(21) Appl. No.: 10/195,304

(22) Filed: Jul. 12, 2002

(65) Prior Publication Data

US 2003/0010481 A1 Jan. 16, 2003

Related U.S. Application Data

(60) Provisional application No. 60/304,987, filed on Jul. 12, 2001.

(51) Int. Cl.
*F28F 1/30* (2006.01)

(52) U.S. Cl. ..... 165/133; 165/151; 165/182; 422/198; 422/201

(58) Field of Classification Search ..... 165/907, 165/181, 133, 151, 905, 182, 51
See application file for complete search history.

(56) References Cited

U.S. PATENT DOCUMENTS

| | | | | | |
|---|---|---|---|---|---|
| 898,107 | A | | 9/1908 | Hill | |
| 2,019,356 | A | * | 10/1935 | Normelli | 62/480 |
| 2,175,394 | A | | 10/1939 | Hewel | |
| 2,471,582 | A | * | 5/1949 | Poole | 165/181 |
| 2,586,250 | A | | 2/1952 | Parker | |
| 2,879,976 | A | * | 3/1959 | Rose, Sr. | 165/122 |
| 3,161,478 | A | | 12/1964 | Chessin | |
| 3,262,190 | A | | 7/1966 | Rostoker et al. | |
| 3,273,356 | A | | 9/1966 | Hoffman | |
| 3,335,790 | A | | 8/1967 | Aranyi et al. | |
| 3,359,616 | A | | 12/1967 | Butt | |
| 3,395,754 | A | | 8/1968 | French | |
| 3,409,075 | A | * | 11/1968 | Long | 165/154 |
| 3,450,199 | A | * | 6/1969 | Warrell | 165/159 |
| 3,487,670 | A | | 1/1970 | Ware | |
| 3,519,070 | A | | 7/1970 | Bappler | |

(Continued)

OTHER PUBLICATIONS

Wadekar, V.V., "Compact Heat Exchangers", CEP Magazine, Dec. 2000, pp. 39-49.

*Primary Examiner*—Terrell McKinnon
(74) *Attorney, Agent, or Firm*—Hamilton, Brook, Smith & Reynolds, P.C.

(57) ABSTRACT

Perforated fins are provided to improve the capabilities of fin and tube type heat exchangers, and to adapt them for flow outside of the tube that is essentially parallel to the axis of the tube. The fins are made of a thermally conductive material, such as metal, with perforations in the fins. Fins can be of any shape. Typically, one or more tubes or binding posts pass through the fins. The fins are attached to the tube or post by press fitting, furnace or torch brazing, welding, or other method of mechanical bonding. The perforations allow heat exchange with the contents of a tube of a fluid flowing essentially parallel to the axis of the tube, in contrast to conventional fin-tube heat exchangers. The fins may also be bonded to a post or other securing means and inserted into the inside of a tube or other hollow body to improve efficiency of heat exchange. In addition, the fins may carry a catalyst, optionally carried on a washcoat or similar treatment to increase surface area.

25 Claims, 7 Drawing Sheets

U.S. PATENT DOCUMENTS 3,540,530 A * 11/1970 Kritzer ..... 165/146
3,595,299 A * 7/1971 Weishaupt et al. ..... 159/28.5
3,610,809 A 10/1971 Elgenbrod
3,692,095 A * 9/1972 Fleming ..... 165/4
3,801,284 A 4/1974 Meckler
3,804,159 A 4/1974 Searight et al.
3,804,162 A 4/1974 Kugler et al.
3,839,974 A 10/1974 Freres
3,947,941 A 4/1976 O'Connor et al.
4,049,048 A * 9/1977 Leedham ..... 165/159
4,129,181 A 12/1978 Janowski et al.
4,138,997 A 2/1979 LaPorte et al.
4,143,710 A 3/1979 La Porte et al.
4,167,936 A * 9/1979 Hackworth ..... 126/587
4,180,897 A 1/1980 Chester
4,222,434 A * 9/1980 Clyde ..... 165/10
4,284,133 A 8/1981 Gianni et al.
4,288,897 A 9/1981 Withers, Jr.
4,359,181 A 11/1982 Chisholm
4,428,420 A * 1/1984 Blakely ..... 165/183
4,648,441 A 3/1987 van de Sluys et al.
4,700,771 A 10/1987 Bennett et al.
4,771,825 A 9/1988 Chen et al.
4,815,533 A * 3/1989 Harada et al. ..... 165/159
4,963,258 A 10/1990 Yagishita
5,009,263 A 4/1991 Seshimo et al.
5,031,693 A 7/1991 VanDyke
5,056,586 A 10/1991 Bemisderfer
5,101,894 A 4/1992 Hendricks
5,145,001 A 9/1992 Valenzuela
5,193,611 A 3/1993 Hesselgreaves
5,252,279 A 10/1993 Gore et al.
5,293,895 A 3/1994 Grove et al.
5,435,381 A 7/1995 Downing et al.
5,558,069 A * 9/1996 Stay ..... 123/541
5,584,340 A * 12/1996 Derosier ..... 165/82
5,585,145 A * 12/1996 Maier-Laxhuber et al. . 427/380
5,626,188 A 5/1997 Dewar et al.
5,704,417 A 1/1998 Christensen et al.
5,833,931 A 11/1998 Fromson et al.
5,854,739 A 12/1998 Steiner et al.
5,918,637 A 7/1999 Fleischman
6,131,644 A * 10/2000 Kohara et al. ..... 165/10
6,140,266 A 10/2000 Corrigan et al.
6,242,712 B1 6/2001 Prust
6,263,955 B1 7/2001 Azar
6,371,200 B1 4/2002 Eaton
6,378,605 B1 * 4/2002 Kutscher et al. ..... 165/181
6,387,555 B1 * 5/2002 Wheeler et al. ..... 429/17
2002/0004152 A1 * 1/2002 Clawson et al. ..... 429/17
2002/0006365 A1 * 1/2002 Suzuki et al. ..... 422/177

* cited by examiner

PERFORATED FIN HEAT EXCHANGERS AND CATALYTIC SUPPORT

RELATED APPLICATION

This application claims the benefit of U.S. Provisional Application No. 60/304,987, filed Jul. 12, 2001, the entire teachings of which are incorporated herein by reference.

BACKGROUND OF THE INVENTION

A variety of heat exchanger types are known. A common form, particularly for air or gas heat exchange with another gas or a liquid, is a fin-tube type exchanger. These are familiar in domestic heating and radiators, for example. In this type, one fluid flows through a tube, and the other fluid, typically a gas, flows essentially perpendicularly to the tube. Fins are attached to the tube to increase the area available for heat exchange, thereby minimizing the length of pipe and the associated pressure drop.

In seeking to further increase the rate of heat exchange from a tube, porous metal foams have been used as replacements for fins. These have the advantage of allowing flow of the outer fluid along the tube length, either counter-current or co-current as needed, and have an excellent ability to transfer heat. However, they are expensive, and can be difficult to bond firmly to a tube.

SUMMARY OF THE INVENTION

In searching for an alternative to currently known heat exchangers, we have found that perforated metal sheets can be advantageously used in a fin-tube type heat exchanger. A tube, or a plurality of tubes, carrying a plurality of fins made of perforated material, allows high rates of heat exchange (proportional to the thermal conductivity of the heat exchange materials) between a first fluid flowing along the interior of the tube and a second fluid, typically a gas, flowing in parallel to the tubes. The fins can be of any shape, and so the heat exchanger can be fitted into irregular spaces of an apparatus if desired. Moreover, the perforated fins can be coated with a catalyst to promote a chemical reaction in the fluid flowing through the fins. Generally, the fins are oriented approximately normal to the tube.

In one aspect, the present invention relates to a heat exchanger comprising a tube adapted to permit the flow of a first fluid inside the tube, and a plurality of fins, each fin contacting the outer surface the tube and oriented generally normal to the tube. Each fin comprises perforations which permit the flow of a fluid through the fin in a direction that is essentially parallel to the tube. The heat exchanger further comprises a container which surrounds the tube and fins, the container arranged to direct the flow of a second fluid through the fins in a direction that is essentially parallel to the tube.

In certain embodiments, the perforated fins can include a catalyst or absorber. Also, the perforated fins can be provided on the inside if the tube as well as on the outer surface of the tube. In some embodiments, the perforated fins can be affixed to the tube. In other embodiments, the fins are not affixed to the tube, and with thermal expansion make contact effective for heat exchange when the fin is at a temperature other than ambient temperature.

The present invention also relates to a method for heat exchange between a first fluid and a second fluid, the method comprising providing a tube having a plurality of perforated fins contacting on the outer surface the tube and oriented generally normal to the tube; flowing a first fluid inside the tube in a direction that is essentially parallel to the tube; and flowing a second fluid through the perforated fins in a direction that is essentially parallel to the tube to promote the exchange of heat between the first fluid and the second fluid.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Definitions

As used herein, unless otherwise specified:

A "fluid" encompasses both a gas and a liquid, as well as a two-phase fluid (mixed liquid and vapor) and a supercritical fluid. The fluid may contain suspended or entrained particles, or solutes.

A "tube" has its conventional meaning of a long hollow structure that separates an inner lumen from the outside in a non-leaking manner; but does not carry its conventional connotations of roundness, convexity or circularity, and may be of any cross-section or of variable cross section or both.

A "fin", unless otherwise specified, is a piece of material, typically of metal, that extends away from a central or surrounding tube in the directions normal to the axis of the tube. The fin is typically mounted so that its plane is normal to the tube axis. However, the fin may instead be mounted to have its plane at an angle with respect to the tube axis. A fin is generally planar, but will have thickness in the direction of the tube axis. The fin's plane may be warped into the axial direction while maintaining the effectiveness of the fin. All of these deviations from perpendicularity to the tube axis are meant to be included in the phrases "generally normal" and "generally perpendicular," unless otherwise specified.

Figure 2:
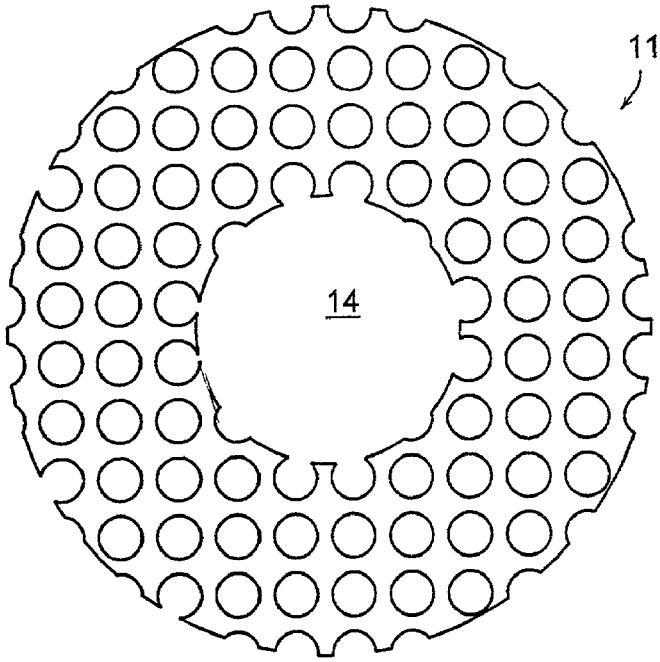
FIG. 2 is a front view of a perforated metal disc.

A "container" is either an outer tube, surrounding the finned tube, or it is a passageway among or between components of a system in which the finned tube heat exchanger is installed. (FIG. 2 illustrates an example of such a container). A container is also referred to as a "housing" herein.

A "fuel processor" is a device for conversion of a hydrocarbon fuel into a mixture comprising hydrogen and carbon dioxide. Fuel processors typically contain multiple operative units, such as a reforming unit, a water-gas-shift unit, a carbon-monoxide removal unit, and other functional devices requiring heat exchange, and several heat exchangers in these units or operating between these units. The hydrogen is typically used in an associated fuel cell, and heat exchange with an associated fuel cell is included in the concept of "fuel processor".

EXAMPLES

Figure 1:
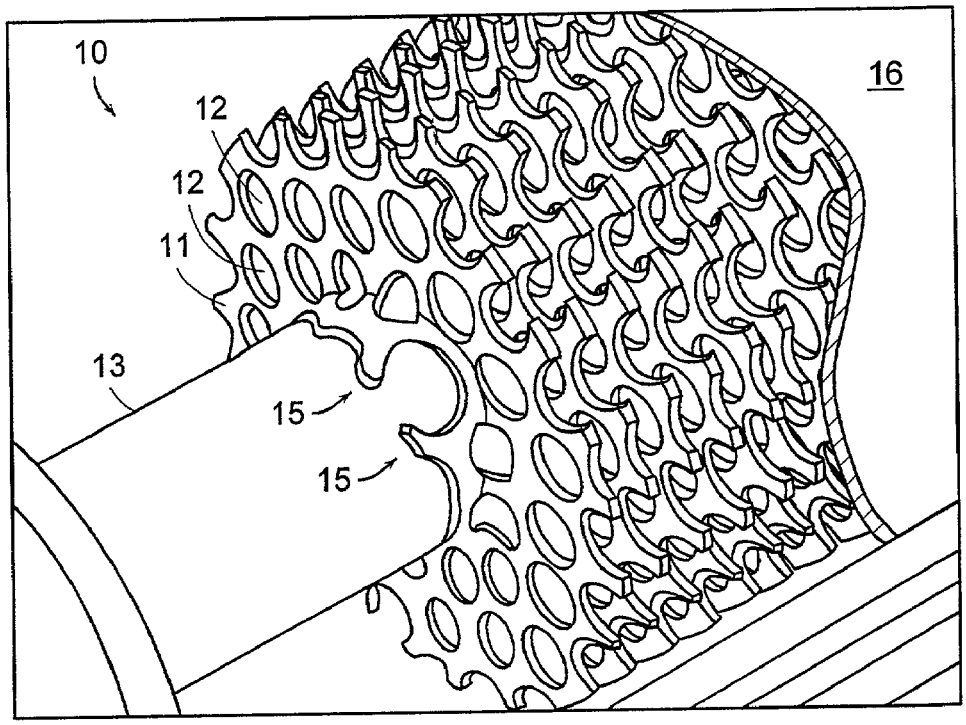
FIG. 1 illustrates a heat exchanger having a plurality of perforated metal discs press-fit onto a central tube.

FIG. 1 shows an example of a heat exchanger 10 according to the principles of the invention. In this embodiment, circular discs 11 (1.5 inches in diameter) with a central hole (0.5 inch diameter) were punched from a 20 g gauge sheet of copper having regular perforations 12. A central flange 15 was formed in the disks by flaring the central hole to obtain a final diameter of 0.75 inch, thereby forming a flange surrounding the hole of about 0.125 inch in height. The punched disk was used as a perforated fin. The fins were slid onto a 0.75 inch diameter tube 13 of 316 stainless. The flanges provided a predetermined spacing of the discs on the tube. This simple press fit provided adequate heat exchange. The fin-tube assembly can also be permanently bonded together, by brazing, for instance, to improve stability and heat exchange. This can be done by coating the tubing with copper brazing material before pressing on the tubes. The assembly can then be brazed in a hot oven and allowed to cool.

In operation, the assembly of FIG. 1 is placed into a close-fitting circular container 16. A first fluid flows through the illustrated tube, and a second fluid flows in the container through the perforations in the fins. The resulting turbulence promotes good mixing.

FIG. 2 is a front view of a perforated circular disc 11 of the heat exchanger shown in FIG. 1. The perforated disc 11 includes a central hole 14 sized to fit the disc onto a tube. The diameter of the central hole 14 can be adjusted by flaring the area around the central hole to produce a central flange area (as shown in FIG. 1). The flange can provide good mechanical and thermal contact between the tube and the disc.

Figure 3:
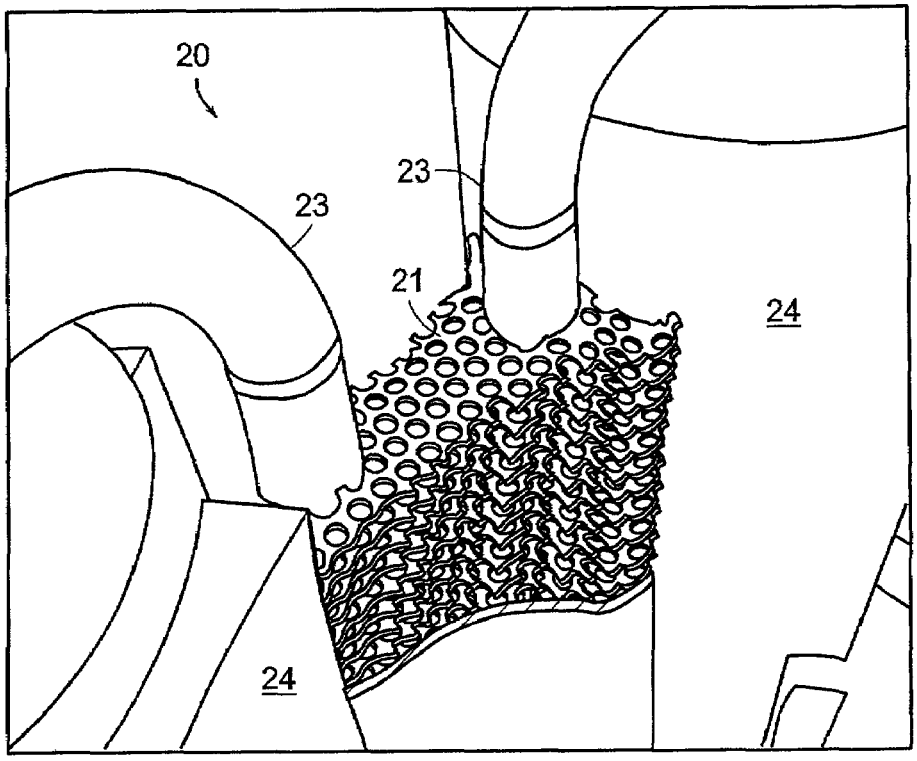
FIG. 3 illustrates another heat exchanger having a plurality of perforated metal fins surrounding two metal tubes.

FIG. 3 illustrates another embodiment of the invention. This example shows how the perforated fin-tube heat exchanger can be fitted into an irregular space in an apparatus. The apparatus in this case is an experimental portable fuel reformer, consisting of multiple functional modules 24 that will ultimately be enclosed in a common housing. A heat exchanger 20 of the invention is illustrated, occupying an irregular space between modules 24. The perforated fins 21 have a "butterfly" or "bow tie" configuration, and there are two tubes 23 in the assembly, in this case joined at the bottom (not visible in the figure). Liquid to be heated flows in through one of the tubes and out through the other, while in final operation one of the gases generated in the reforming process will flow past and through the perforated fins, donating heat to the liquid being heated.

Figure 4A:
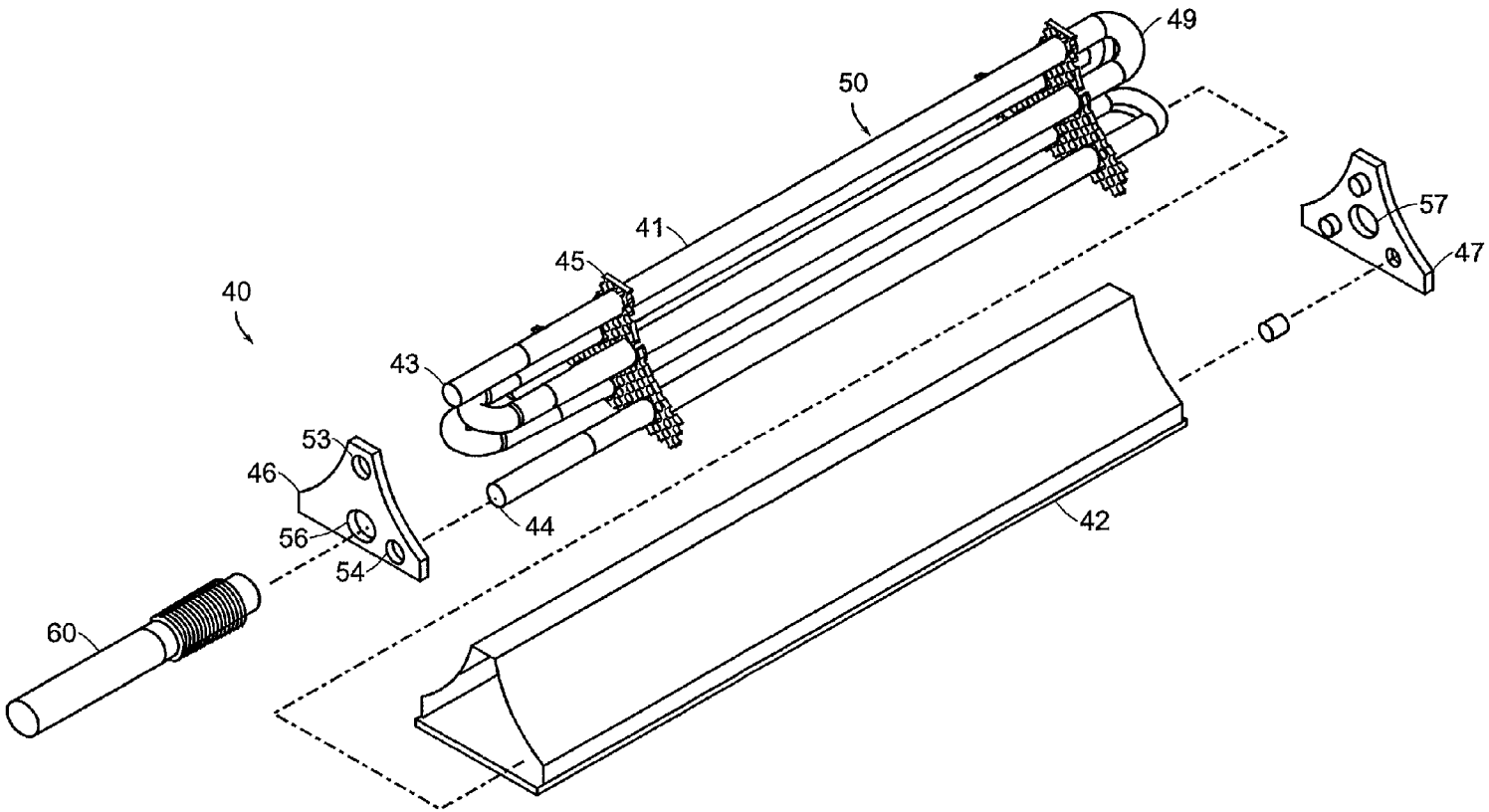
FIG. 4*a* is an exploded view of yet another heat exchanger according to the invention.
Figure 4B:
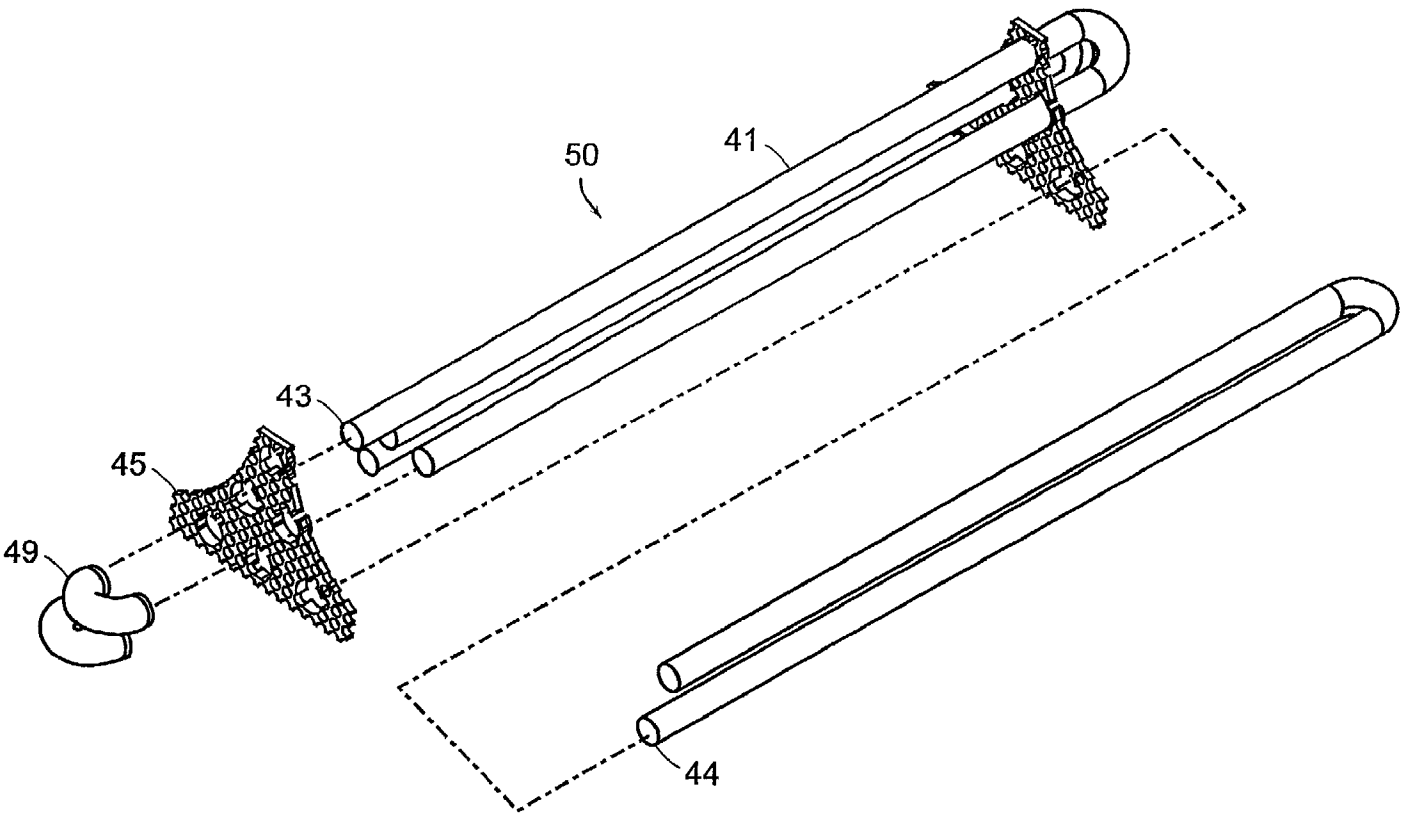
FIG. 4*b* is an exploded view of the fin/tube assembly of the heat exchanger of FIG. 4*a;*
Figure 4C:
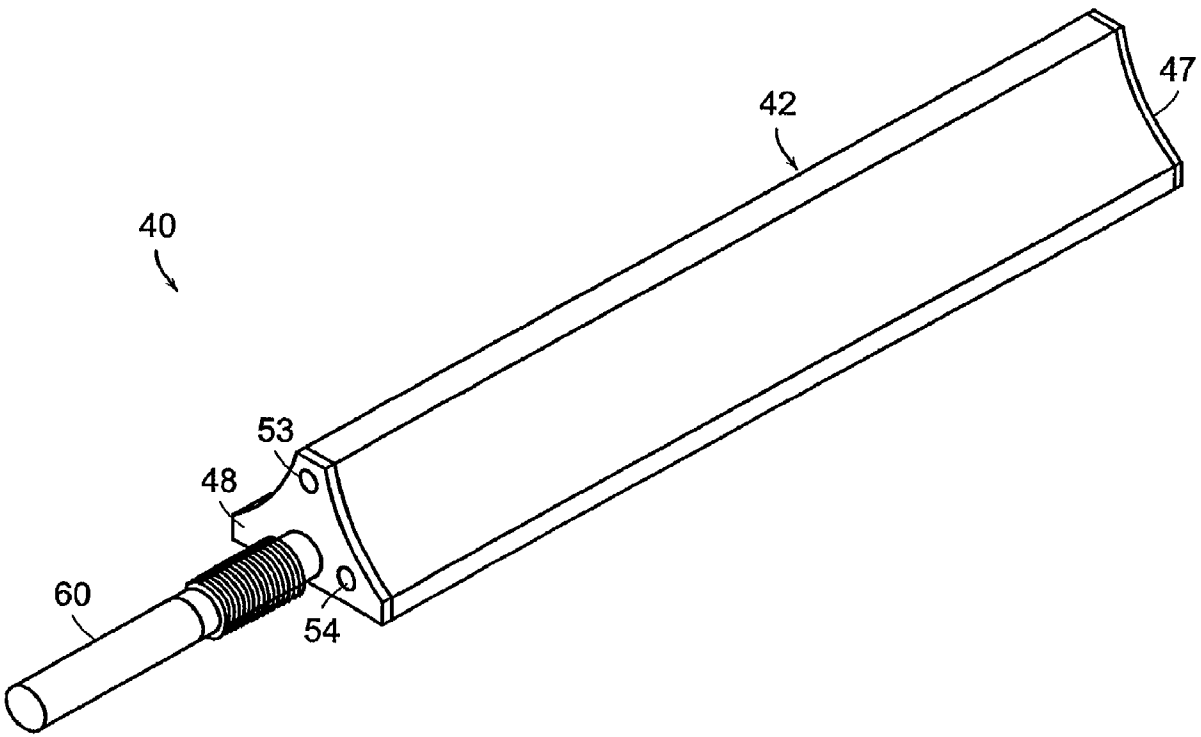
FIG. 4*c* is a perspective view of the heat exchanger of FIG. 4*a;*

FIGS. 4*a, b,* and *c* illustrate yet another embodiment of the invention. In this example, the heat exchanger 40, shown in exploded view in FIG. 4*a*, comprises six tubes 41 enclosed in a common container or housing 42. Perforated fins 45 with openings 48 corresponding to each of the tubes are then pressed over the tube assembly. Optionally, the fins can be brazed to the exterior of the tubes. Return bends 49 can be secured to the ends of the tubes (as shown in FIG. 4*b*) to provide a continuous fluid flow path from an inlet 43 to an outlet 44. The entire fin/tube assembly 50 is enclosed in housing 42 (as shown in FIG. 4*c*). The housing includes a pair of end caps 46, 47. As shown in FIG. 4*a*, one of the end caps 46 includes openings 53, 54 corresponding to the fluid inlet 43 and outlet 44 of the fin/tube assembly. Also, both of the end caps 46, 47 include a large central openings 56, 57 for a second heat transfer fluid.

In operation, a first fluid, which can be a liquid, flows from the fluid inlet 43 through each of the tubes 41 and exits through outlet 44. The second fluid enters the housing 42 via tube 60 connected to end cap opening 53, passes over and through the fin/tube assembly 50, and exits the housing through the opposite end cap opening 54. Preferably, the first fluid and the second fluid enter the heat exchanger at different temperatures, and the perforated fins 45 promote the transfer of heat between the two fluids. In one embodiment, first fluid enters the heat exchanger as a liquid and the second fluid enters the heat exchanger as a hot gas or steam, and the hot gas or steam of the second fluid transfers heat to the first fluid, converting it from a liquid into steam.

Figure 4D:
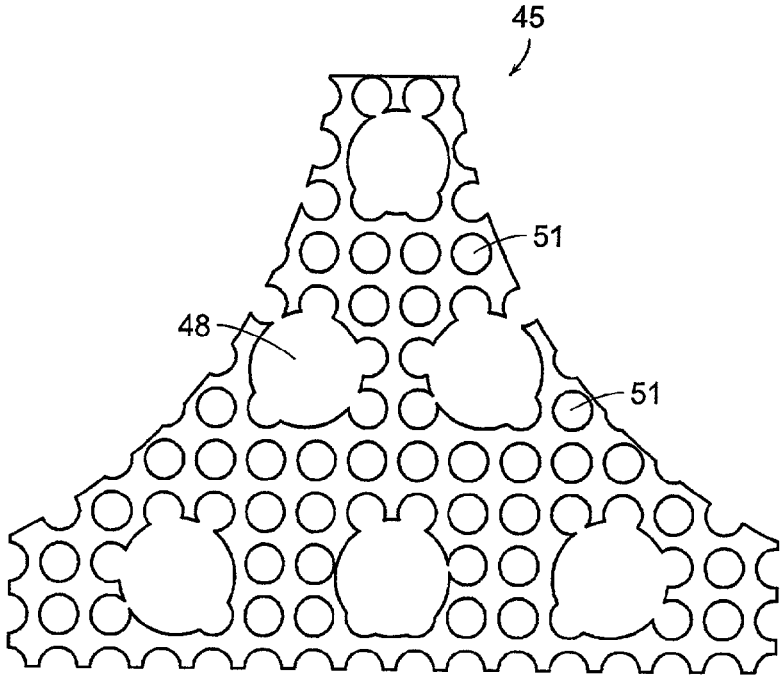
FIG. 4*d* is a front view of a perforated fin of the heat exchanger of FIG. 4*a;*
Figure 4E:
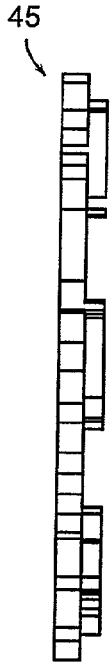
FIG. 4*e* is a side view of the perforated fin of FIG. 4*d;*
Figure 4F:
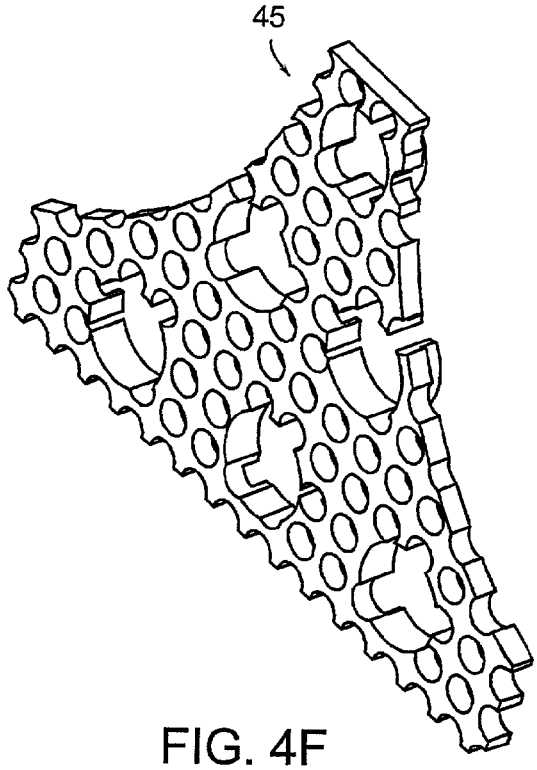
FIG. 4*f* is a perspective view of the perforated fin of FIG. 4*d;*

FIGS. 4*d, e,* and *f* show, respectively, a front, side, and perspective view of a perforated fin 45 according to this embodiment. The fin 45 includes openings 48 for the tubes, which carry the first fluid, and perforations 51, which permit the second fluid to flow through the housing and transfer heat to or from the first fluid. As shown here, the overall shape of the fin 45 is made to conform to the irregular shape of the interior of the heat exchanger housing. The fin 45 also helps to maintain the alignment and regular spacing of the tubes within the housing.

Figure 5A:
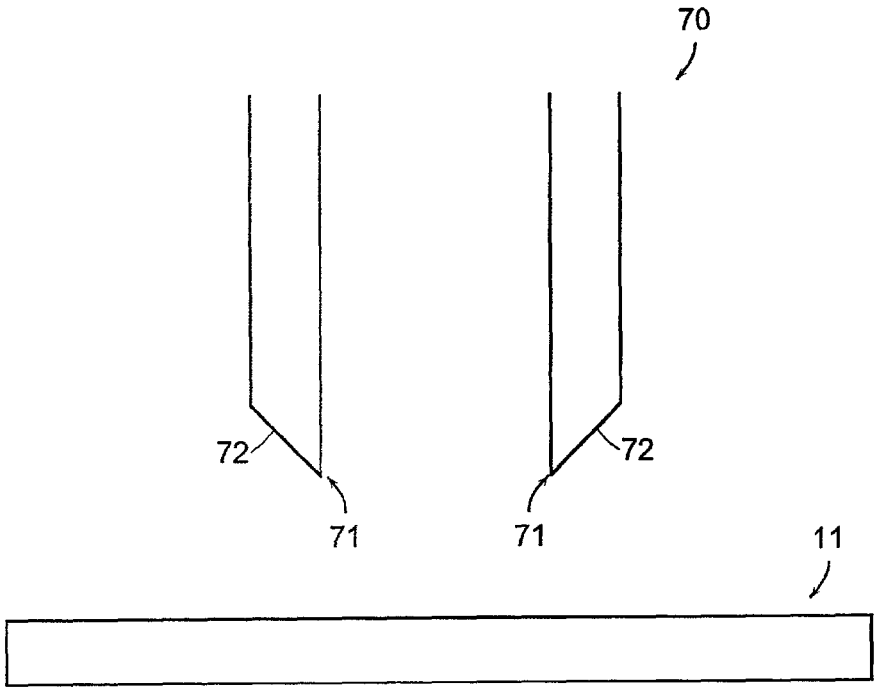
FIG. 5*a* is a cross-sectional view of a sheet of perforated metal and a cutting tool for forming a central opening and flange in the perforated metal.
Figure 5B:
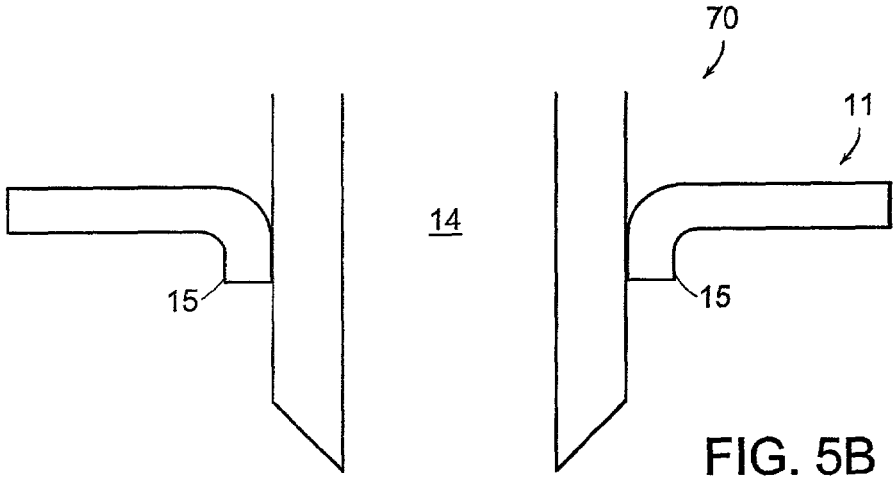
FIG. 5*b* is a cross-sectional view of a sheet of perforated metal after being cut by the cutting tool.

FIGS. 5*a* and 5*b* illustrate a method of forming a central hole and flange in a perforated fin 11. A cutting tool 70 is provided which has a cutting edge 71 and shaping edge 72. The outer diameter of the cutting tool 70 is approximately equal to the outer diameter of the tube to which the fin will contact. The difference between the outer diameter of the cutting tool 72 and the diameter of the cutting edge 71 determines the size of the central flange portion 15 (see FIG. 1) of the perforated fin. The cutting edge 71 of the tool 70 is pressed against the fin 11 with a force sufficient to cut through the fin 11 and form the central hole 14. As the fin is being cut by the tool, the shaping edge 72 simultaneously bends or flares out a region of the fin adjacent to the central hole 14 to produce a central flange 15, as shown in FIG. 5*b*. An advantage of this method is that both the central hole and the flange can be easily formed in a single step.

Materials

Because of its high thermal conductivity, metal, including a metallic alloy, is a preferred material for construction of the fins and the tubes. Any metal or alloy that is chemically compatible with the fluids to be treated is potentially suitable. Potentially suitable metals include, but are not limited to, aluminum, brass, copper, stainless steel, mild steel, titanium, nickel and chromalloy. In most configurations, it is preferable that the material of the tube and the fins be the same, or else that the materials if different have similar coefficients of expansion when heated. (An exception is described below.) The material of the container need not necessarily be a good heat conductor, depending on the detail of the intended use, and may carry insulation if required.

The size of the perforations, and the density of the fins along the tubes, will be determined by the requirements of the particular heat exchanger. Higher densities of fins along the tube and smaller holes (occupying the same area fraction of the fins) will each tend to increase the pressure drop, while somewhat improving the rate of heat transfer. The design process will center on minimizing pressure drop at a sufficient rate of heat transfer (or on supplying a required amount of pressure drop where required.). Since these devices are easy to make as prototypes, and can readily be modeled, experimentation to ensure the correct properties is straightforward.

Alternative Configurations

The embodiments illustrated in the Figures show a design in which a hollow tube is surrounded on the outside by perforated fins. The perforated fins can also be used on the inside of a tube. For simplicity in fabrication, the fins can be affixed to a solid metal carrier (a "post") and then the assembly can be fitted into a hollow tube. The fit may be solely by pressure, or the fins may be brazed to the inner surface of the tube. Alternatively, the fins can simply be pressed into the tube, with spacing maintained by flanges similar to those illustrated, optionally (and preferably) on the outside edge of the fins. Alternatively, good contact between the fins and the inner tube surface can be provided by making the fins from a material with a higher coefficient of thermal expansion than the tube, so that inserting is easy, while contact will be made at the operating temperature of the heat exchanger due to differential expansion of the fins.

The tube illustrated is round, but a tube of any cross-section geometry can be accommodated in the invention. A gradient in tube size can be accommodated by having a set of fins with graduated sizes in the central hole, or the outer diameter, or both.

The fins can be made of any porous material having sufficient mechanical strength to resist the force of the fluid flowing through the fins, and that causes only an acceptable pressure drop through the assembly. Thus the selection of material form will depend on the nature of the fluid. Perforated metal sheets, having inherent rigidity, have been used in the examples above. However, other formats providing the same effect can be used. These formats include, without limitation, woven and non-woven wire assemblies—for example, punched from screening, or from metal "wool" such as steel wool. Coarser or more rigid screening can be used to mechanically stabilize formats that are too flexible or friable. Microporous fins can be used, particularly to increase the surface area for catalysis. These in turn would typically be more coarsely punched to supply the correct pressure drop.

The perforated fins may also be formed by providing slits in a staggered relationship in a sheet of metal or other material, and then expanding the sheet so that the slits open to form holes. The fins can also be formed from a material that has been cast or molded to include a series of holes.

The fins are illustrated as being essentially normal to the axis of the tube. This simple configuration is preferred, but the fins could be at an angle to the tube axis without affecting their function. For example, angles up to 45 degrees, or even 60 degrees or more, would still be functional. In addition, the fins are illustrated as being essentially flat, except for the flange. It is efficient to make flat fins from flat perforated stock, but the fins could be non-planar (bent or warped) and still achieve the desired function. Finally, the flanges are preferred for convenience, and for providing good thermal contact with the tube, but flanges on the fins are not essential to the invention. Any workable method of spacing the fins at desired intervals along the tube can potentially achieve the same effect. For example, fins could be separated by small diameter washers or ferrules. Brazing or welding such an assembly would provide reasonable heat transfer from the tube to the fins.

Catalytic and Absorptive Coatings

The fins, and optionally the tubes, can be coated with a catalytic material so that a chemical reaction is conducted in conjunction with the heat transfer. This is particularly efficient when heat needs to be removed from or supplied to the catalyst in conjunction with the reaction. Any useful catalyst is potentially useable in this mode. The fins can be wash-coated, using methods known in the art, to provide additional effective surface area for the support of the catalyst. As an alternative or in addition, the catalyst could be replaced or supplemented with a material specifically absorbing a particular substance from the fluid flowing over the fins. Since the fin/tube is typically a non-disposable component, a regeneration cycle would preferably be provided. As an alternative or in addition, the surface area of the fins could be increased by making them of an inherently porous material. Examples of suitable materials for this purpose include porous stainless steel, or another sintered or woven metal, or compressed metallic wool. Then the overall pressure drop could be controlled by providing coarser perforations, similar to those illustrated, while diffusion into the porous regions would enhance the overall catalytic activity. A porous layer could also be deposited onto the fins to increase the effective catalytic or absorptive area.

When the chemistry is appropriate and the heat exchange capacity remains adequate, the fins may be composed of a catalytic material. For example, materials such as copper and nickel are catalytic in some reactions.

APPLICATIONS

The perforated-fin tube heat exchanger of the invention is likely to be somewhat more expensive to fabricate than a non-porous fin/tube exchanger having equivalent capacity to exchange heat with the fluid in the tube, simply because perforated metal is somewhat more expensive than the equivalent sheet. The perforated-fin devices will be preferred where compactness and a high rate of heat exchange are needed. They will be especially advantageous when there is a need for their "shape-fitting" quality, when the fins are specifically shaped to take advantage of a non-circular region in a reactor or other apparatus. They also have an advantage when the material inside the tube is dangerous, as the containment outside of the fins can provide a secondary means of leak control.

In the context of fuel processors and fuel reformers, many of the required heat exchanges can be performed more efficiently with these devices. These include "boiling" heat exchangers for converting water to steam (illustrated in FIG. 2); catalytic heat exchange in several contexts, including gas cleanup devices such as preferential oxidation reactors (PrOx devices); and gas to gas heat exchange in extraction of residual heat from exhaust gas or in cooling of reformate.

More generally, the perforated-fin heat exchanger, with or without catalyst or absorbent, is useful in any application requiring compactness. These include heat exchange in vehicles, including land vehicles, boats, submarines, aircraft and spacecraft. They can be useful in high-efficiency generation of hot air and/or hot water when space is at a premium. The "confinement" advantage, providing an extra layer of confinement for materials carried in a central tube, can prove useful in conjunction with any chemical, nuclear, or biological reactor, or in extractors of all sorts.

The use of a perforated fin heat exchanger has been illustrated for heat transfer between two fluids, across a tube. Concurrent heat exchange among three or more fluids can be provided by configuring the container or housing as a tube, and providing a set of perforated fin heat exchangers thereon, followed by another exterior container. Additional layers of heat exchange can be provided in this manner if required by the heat exchange needs of the particular apparatus. Multiple layers of heat exchange can be useful in complex processing systems, such as shown and described in co-pending U.S. application Ser. No. 10/012,195, filed on Dec. 5, 2001, the entire contents of which are incorporated herein by reference.

While this invention has been particularly shown and described with references to preferred embodiments thereof, it will be understood by those skilled in the art that various changes in form and details may be made therein without departing from the scope of the invention encompassed by the appended claims.

What is claimed is:

1. A heat exchanger comprising:

a tube adapted to permit the flow of a first fluid inside the tube;

a plurality of fins, each fin contacting the outer surface of the tube and oriented generally normal to the tube, each fin comprising perforations to permit the flow of a second fluid therethrough in a direction that is essentially parallel to the tube, at least one of the fins comprising a material for facilitating a change in the composition of the second fluid; and a container surrounding the tube and fins, the container arranged to direct the flow of the second fluid through the fins in a direction that is essentially parallel to the tube to promote the exchange of heat between the first fluid and the second fluid.

2. The heat exchanger of claim 1, wherein at least one of the perforated fins comprises a catalyst.

3. The heat exchanger of claim 1, wherein at least one of the perforated fins comprises a chemical absorbent.

4. The heat exchanger of claim 1, wherein at least one fin is affixed to the tube.

5. The heat exchanger of claim 1, wherein the heat exchanger is incorporated in a plant comprising at least one of a chemical reactor, a nuclear reactor, a biological reactor, and a chemical extraction process.

6. The heat exchanger of claim 1, wherein an output of the heat exchanger comprises at least one of heated air and heated water.

7. The heat exchanger of claim 1, wherein at least one fin comprises a bent portion for increasing the contact area between the fin and the tube.

8. A method for heat exchange between a first fluid and a second fluid, comprising the steps of:

providing a tube having a plurality of fins contacting the outer surface of the tube and oriented generally normal to the tube, each fin comprising perforations to permit the flow of a fluid therethrough, the plurality of fins not extending through the tube;

flowing a first fluid inside the tube in a direction that is essentially parallel to the tube; and flowing a second fluid through the fins in a direction that is essentially parallel to the tube to promote the exchange of heat between the first fluid and the second fluid, at least one of the fins comprising a material for facilitating a change in the composition of the second fluid.

9. The method of claim 8, further comprising:

providing a container surrounding the tube and fins, the container arranged to direct the flow of a second fluid through the fins.

10. The method of claim 8, wherein at least one of the perforated fins comprises a catalyst.

11. The method of claim 8, wherein at least one of the perforated fins comprises chemical absorbent.

12. The method of claim 8, wherein the device is incorporated in a plant comprising at least one of a chemical reactor, a nuclear reactor, a biological reactor, and a chemical extraction process.

13. The method of claim 8, wherein the method produces at least one of heated air and heated water.

14. The method of claim 8, wherein at least one fin is affixed to the tube.

15. The method of claim 8, wherein at least one fin comprises a bent portion for increasing the contact area between the fin and the tube.

16. A heat exchanger comprising:

a tube adapted to permit the flow of a first fluid inside the tube;

a plurality of fins, each fin contacting the outer surface of the tube and oriented generally normal to the tube, each fin comprising perforations to permit the flow of a fluid therethrough in a direction that is essentially parallel to the tube;

a container surrounding the tube and fins, the container arranged to direct the flow of a second fluid through the fins in a direction that is essentially parallel to the tube to promote the exchange of heat between the first fluid and the second fluid; and at least one internal fin contacting the interior surface of the tube and oriented generally normal to the tube, the internal fin comprising perforations to permit the flow of a fluid in a direction that is essentially parallel to the tube, the plurality of fins contacting the outer surface of the tube and the at least one internal fin contacting the interior surface of the tube not extending through the tube; at least one of the fins contacting the outer surface of the tube, or at least one of the internal fins, comprising a material for facilitating a change in the composition of a fluid flowing through the heat exchanger.

17. The heat exchanger of claim 16, wherein at least one fin is affixed to the tube.

18. The heat exchanger of claim 16, wherein at least one fin is not affixed to the tube and makes contact effective for heat exchange when the fin is at a temperature other than ambient temperature.

19. A heat exchanger comprising:

a tube adapted to permit the flow of a first fluid inside the tube;

a plurality of fins, each fin contacting the outer surface of the tube and oriented generally normal to the tube, each fin comprising open perforations to permit the flow of a fluid therethrough in a direction that is essentially parallel to the tube; and a container surrounding the tube and fins, the container arranged to direct the flow of a second fluid through the fins in a direction that is essentially parallel to the tube to promote the exchange of heat between the first fluid and the second fluid, the heat exchanger being incorporated in a fuel processor for converting hydrocarbon fuel into a mixture comprising hydrogen.

20. The heat exchanger of claim 19, wherein the fuel processor is incorporated in a vehicle.

21. In a fuel processor for converting hydrocarbon fuel into a mixture comprising hydrogen, a method for heat exchange between a first fluid and a second fluid, comprising the steps of:

providing a tube having a plurality of fins contacting the outer surface of the tube and oriented generally normal to the tube, each fin comprising open perforations to permit the flow of a fluid therethrough;

flowing a first fluid inside the tube in a direction that is essentially parallel to the tube; and flowing a second fluid through the fins in a direction that is essentially parallel to the tube to promote the exchange of heat between the first fluid and the second fluid.

22. The method of claim 21, wherein the fuel processor is incorporated in a vehicle.

23. A heat exchanger comprising:

a tube adapted to permit the flow of a first fluid inside the tube;

a plurality of fins, each fin contacting the outer surface of the tube and oriented generally normal to the tube, each fin comprising perforations to permit the flow of a fluid therethrough in a direction that is essentially parallel to the tube; and a container surrounding the tube and fins, the container arranged to direct the flow of a second fluid through the fins in a direction that is essentially parallel to the tube to promote the exchange of heat between the first fluid and the second fluid, at least one fin not affixed to the tube and making contact effective for heat exchange when the fin is at a temperature other than ambient temperature.

24. A method for heat exchange between a first fluid and a second fluid, comprising the steps of:

providing a tube having a plurality of fins contacting the outer surface of the tube and oriented generally normal to the tube, each fin comprising perforations to permit the flow of a fluid therethrough;

flowing a first fluid inside the tube in a direction that is essentially parallel to the tube; and flowing a second fluid through the fins in a direction that is essentially parallel to the tube to promote the exchange of heat between the first fluid and the second fluid; and providing at least one internal fin contacting the interior surface of the tube and oriented generally normal to the tube, the internal fin comprising perforations to permit the flow of a fluid in a direction that is essentially parallel to the tube, the plurality of fins contacting the outer surface of the tube and the at least one internal fin contacting the interior surface of the tube not extending through the tube; at least one of the fins contacting the outer surface of the tube, or at least one of the internal fins, comprising a material for facilitating a change in the composition of a fluid flowing through the heat exchanger.

25. A method for heat exchange between a first fluid and a second fluid, comprising the steps of:

providing a tube having a plurality of fins contacting the outer surface of the tube and oriented generally normal to the tube, each fin comprising perforations to permit the flow of a fluid therethrough;

flowing a first fluid inside the tube in a direction that is essentially parallel to the tube; and flowing a second fluid through the fins in a direction that is essentially parallel to the tube to promote the exchange of heat between the first fluid and the second fluid, at least one fin not affixed to the tube and making contact effective for heat exchange when the fin is at a temperature other than ambient temperature.

* * * * *